US009205545B2

(12) United States Patent
Huang

(10) Patent No.: US 9,205,545 B2
(45) Date of Patent: Dec. 8, 2015

(54) AUXILIARY HANDLE OF PNEUMATIC TOOL

(71) Applicant: APACH INDUSTRIAL CO., LTD., Taichung (TW)

(72) Inventor: Chun-Ming Huang, Taichung (TW)

(73) Assignee: APACH INDUSTRIAL CO., LTD., Taichung (TW)

( * ) Notice: Subject to any disclaimer, the term of this patent is extended or adjusted under 35 U.S.C. 154(b) by 258 days.

(21) Appl. No.: 14/061,925

(22) Filed: Oct. 24, 2013

(65) Prior Publication Data

US 2015/0114187 A1 Apr. 30, 2015

(51) Int. Cl.
*B25C 1/04* (2006.01)
*B25C 1/00* (2006.01)

(52) U.S. Cl.
CPC .. *B25C 1/04* (2013.01); *B25C 1/008* (2013.01)

(58) Field of Classification Search
CPC ..... B25C 1/04; B25C 1/008; B25C 5/13; B25G 1/00; B25F 5/02
See application file for complete search history.

(56) References Cited

U.S. PATENT DOCUMENTS 7,418,892 B2 * 9/2008 Taylor ..... B25F 5/027 16/426
2013/0228606 A1 * 9/2013 Staples ..... B25F 5/026 227/8

FOREIGN PATENT DOCUMENTS

TW 201038373 A * 11/2010 ..... B25C 1/04

* cited by examiner

*Primary Examiner* — David B Thomas
(74) *Attorney, Agent, or Firm* — Ming Chow; Sinorica, LLC

(57) ABSTRACT

An auxiliary handle of a pneumatic tool includes a gripping member, a tube, a first urging member, a pole, a second urging member and a lever. The auxiliary handle makes the user to hold the pneumatic tool with both hands. The lever is pivoted on the gripping member to be pressed to move the pole, and consequently, gas flows in the auxiliary handle are changed. As a result, the pneumatic tool will not take any action if the user only pulls a trigger of the pneumatic tool without pressing the lever.

3 Claims, 10 Drawing Sheets

AUXILIARY HANDLE OF PNEUMATIC TOOL

BACKGROUND OF THE INVENTION

1. Technical Field

The present invention relates to a pneumatic tool, and more particularly to an auxiliary handle of a pneumatic tool.

2. Description of Related Art

A pneumatic tool, such as nail gun, is a tool driven by compressed gas to drive nails into an object. Typically, there are complex gas passageways in the conventional nail gun which allow compressed gas flowing through to drive the nails. The driving force of a nail gun is so strong that it would cause an accident if the operator uses it in an incorrect way. It is an important issue to provide a safe way in operating such pneumatic tools.

BRIEF SUMMARY OF THE INVENTION

In view of the above, the primary objective of the present invention is to provide an auxiliary handle of a pneumatic tool, which provides a safe way in operating the pneumatic tool.

In order to achieve the objective of the present invention, an auxiliary handle of a pneumatic tool, wherein the pneumatic tool has a trigger, and the auxiliary handle includes a gripping member, a tube, a first urging member, a pole, a second urging member, and a lever, wherein the gripping member is connected to the pneumatic tool, and has a room therein and an opening communicated with the room; the gripping member further has a first bore, a second bore and a third bore, each of which is communicated with the room, wherein the first bore is closed or opened when the trigger is pulled; the tube is received in the room of the gripping member to be moved between a first position and a second position, and has a first aperture and a second aperture, wherein the tube is moved to the first position by compressed gas, which enters the room via the first bore; the first urging member is received in the room of the gripping member to keep moving the tube from the first position toward the second position; the pole is received in the tube to be moved between a third position and a fourth position, wherein the pole has a front end extending out of the gripping member through the opening; the second urging member is received in the room of the gripping member to keep moving the pole from the fourth position toward the third position; the lever is pivoted on the gripping member to be moved between a normal position and a pressed position, wherein the lever has a pressing portion in touch with the front end of the pole to move the pole to the fourth position when the lever is moved to the pressed position.

In an embodiment, the gripping member has shaft, a lid and a plug; the first bore, the second bore, and the third bore are provided on the shaft, and the room is provided in the shaft; the lid is connected to an end of the shaft, and the opening is provided on the lid; the plug is received in the room to close an opposite end of the shaft.

In an embodiment, the pole is provided with a channel, and the tube further has a third aperture to be communicated with the channel.

Whereby, the pole closes the first aperture of the tube, and the second aperture of the tube is communicated with the first bore and the third bore when the pole is moved to the fourth position, and a direction of a gas flow between the first bore and the third bore is changed by pulling the trigger. Therefore, the process of driving nails with the pneumatic tool can only be successfully done when the operation is performed with ordered actions, which satisfies higher security requirement.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
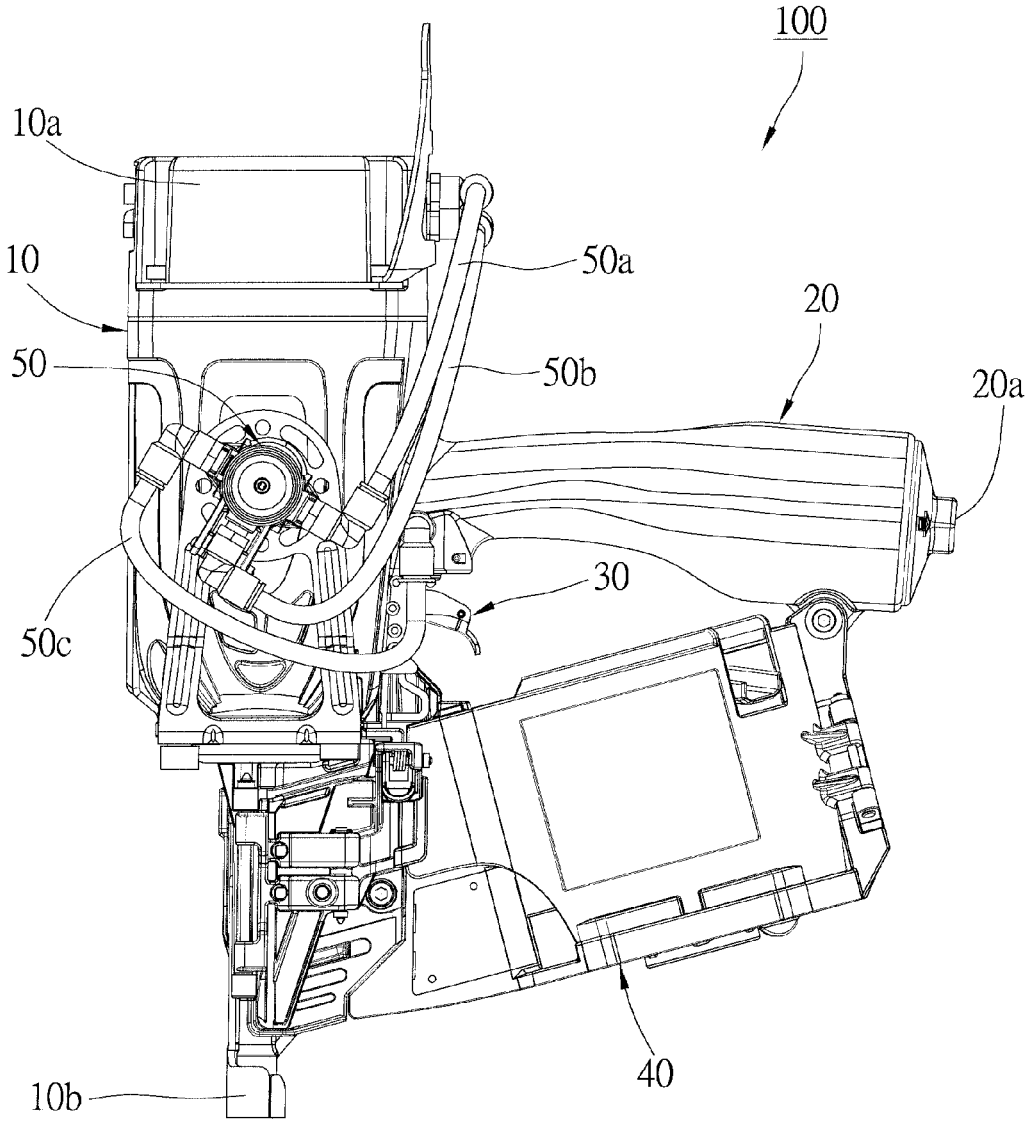
FIG. 1 is a front view of a preferred embodiment of the present invention.
Figure 2:
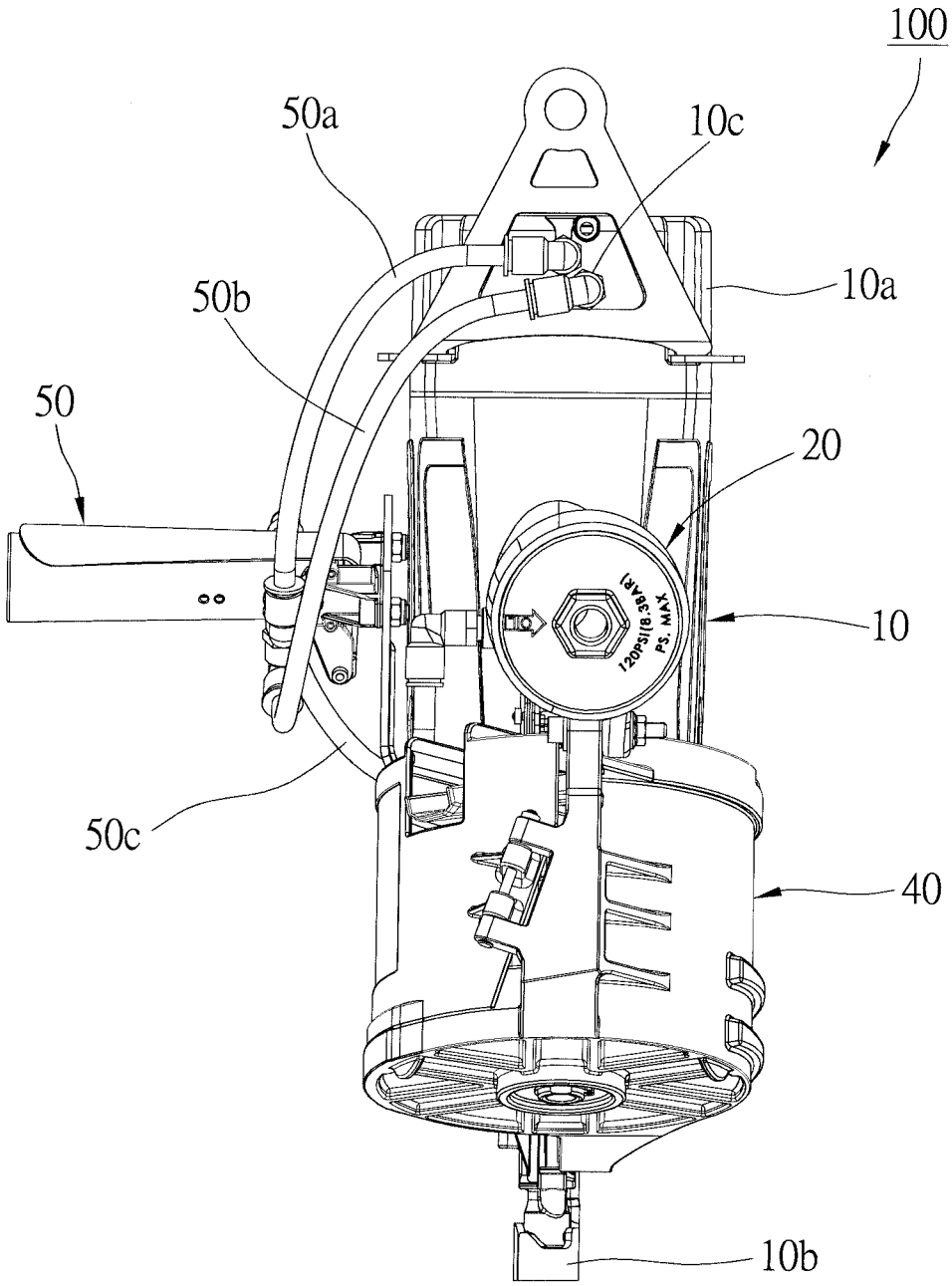
FIG. 2 is a right view of the preferred embodiment of the present invention.
Figure 3:
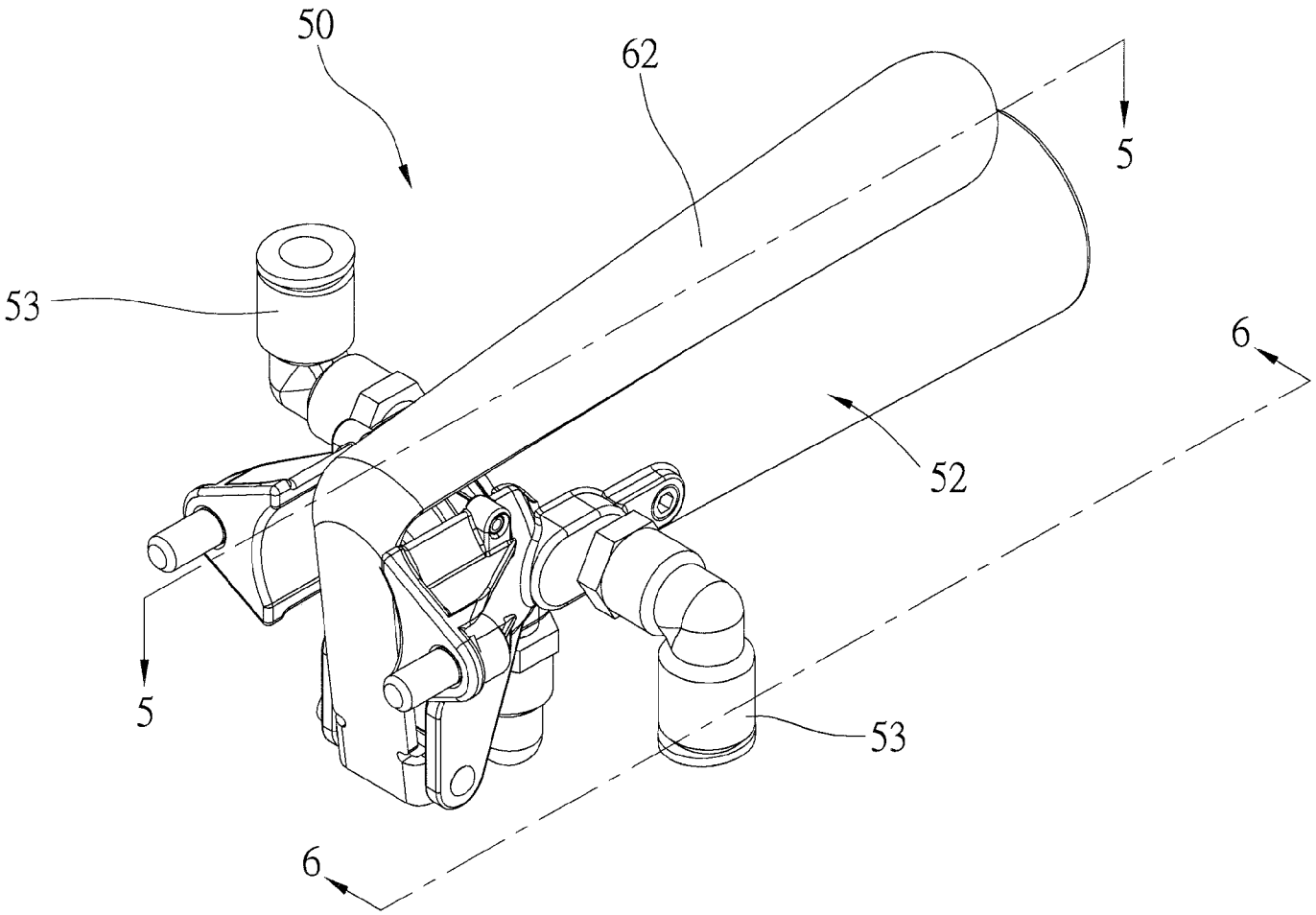
FIG. 3 is a perspective view of the preferred embodiment of the present invention.
Figure 4:
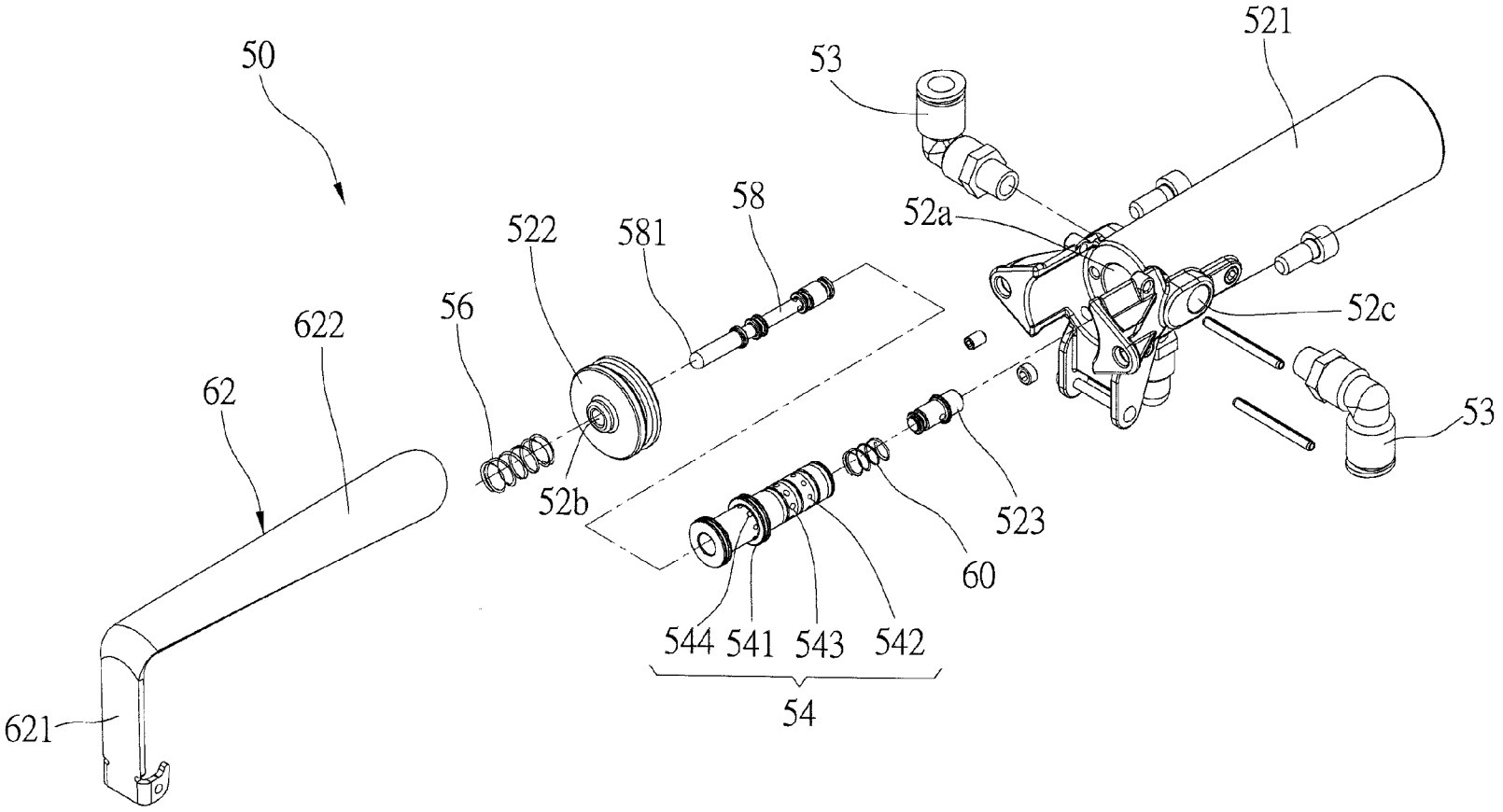
FIG. 4 is an exploded view of the preferred embodiment of the present invention.

As shown in FIG. 1 and FIG. 2, a pneumatic tool 100 of the preferred embodiment of the present invention is a nail gun, which includes a main body 10, a handle 20, a trigger 30, a nail magazine 40 and an auxiliary handle 50. The main body 10 has a cylinder 10*a* in an up section thereof and a muzzle 10*b* on a bottom thereof. The handle 20 is connected to the main body 10 to be held by a user. A valve stem 20*a* is on a bottom of the handle 20 to connect to a compressed gas supply hose (not shown). The trigger 30 is pivoted on the main body 10 to be pulled by a finger. The nail magazine 40 is connected to the muzzle 10*b* and the bottom of the handle 20 to feed nails. The auxiliary handle 50 is connected to the main body 10 to be held by the other hand of the user. The auxiliary handle 50 is provided with three hoses 50*a*, 50*b*, and 50*c*. The hose 50*a* is connected to the cylinder 10*a*, the hose 50*b* is connected to a lid bore 10*c*, and the hose 50*c* is connected to the trigger 30. These hoses 50*a*, 50*b*, and 50*c* increase the safety in operating the nail gun 10.

As shown in FIG. 3 to FIG. 6, the auxiliary handle 50 has a gripping member 52, a tube 54, a first urging member 56, a pole 58, a second urging member 60, and a lever 62. The gripping member 52 has a shaft 521 connected to the main body 10. The shaft 521 has a room 52*a* therein. A lid 522 is connected to a front end of the shaft 521 to close an end of the room 52*a*. The lid 522 has an opening 52*b* communicated with the room 52*a*. A plug 523 is received in the room 52*a* for sealing the room 52*a*. The shaft 521 is provided with a first bore 52*c*, a second bore 52*d* and a third bore 52*e*, which are communicated with the room 52*a*. Three valve stems 53 are connected to the bores 52*c*, 52*d*, and 52*e* respectively. The first bore 52*c* is closed when the trigger 30 is pulled.

Figure 5:
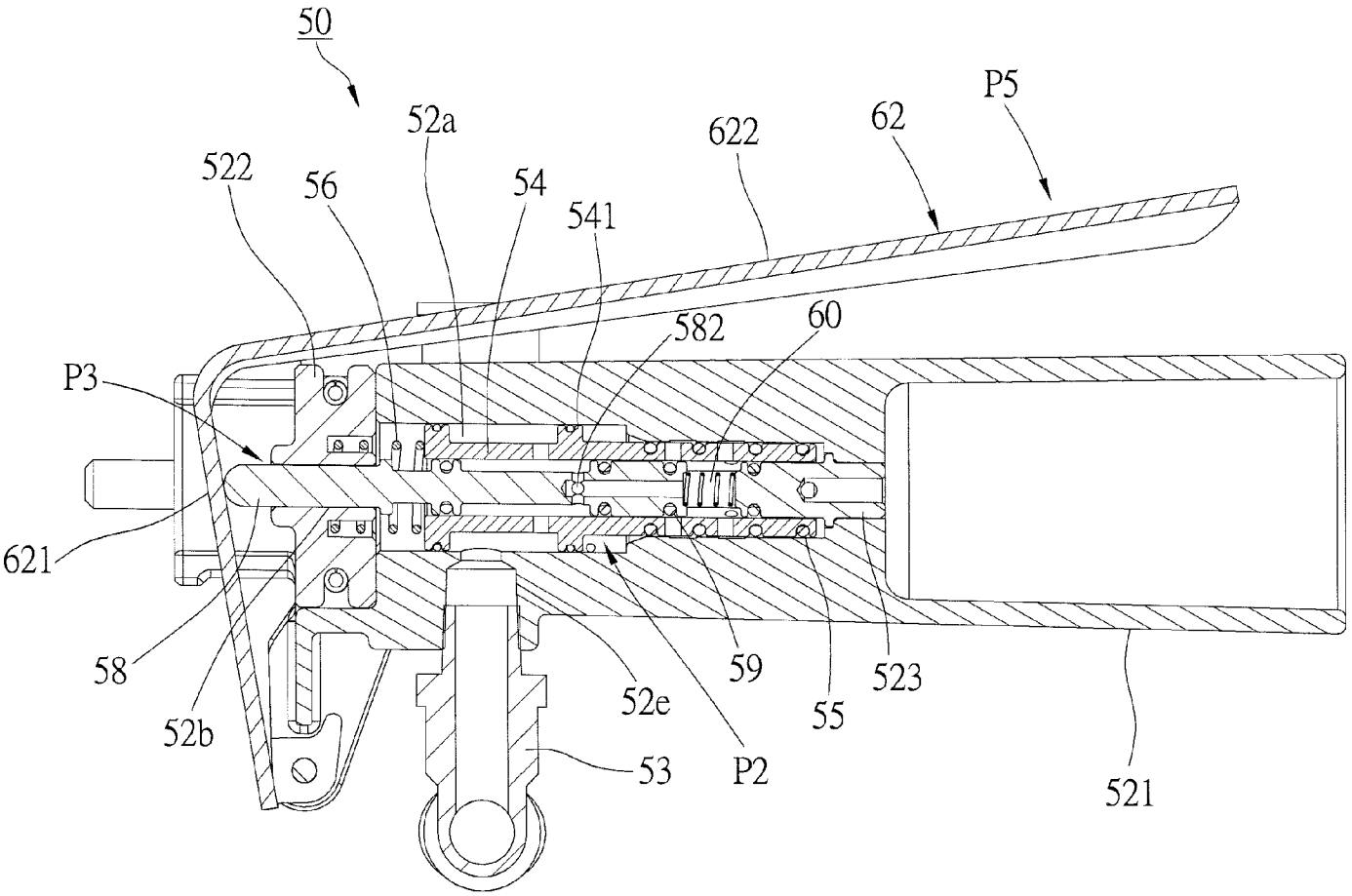
FIG. 5 is a sectional view in the 5-5 line of FIG. 3, showing the relations between the components of the auxiliary handle while the auxiliary handle is not connected to the compressed gas supply yet.
Figure 6:
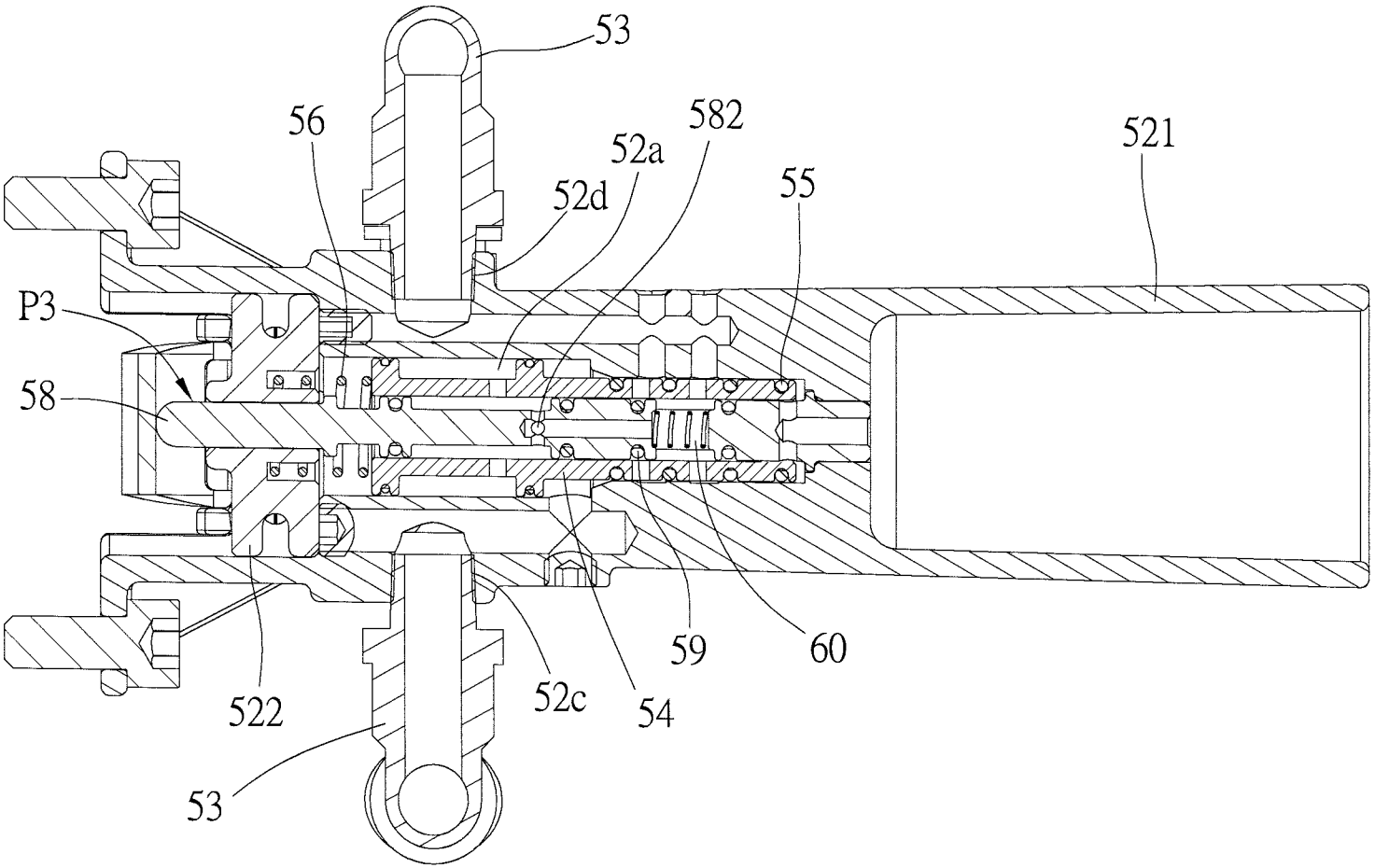
FIG. 6 is a sectional view in the 6-6 line of FIG. 3, showing the relations between the components of the auxiliary handle while the auxiliary handle is not connected to the compressed gas supply yet.
Figure 7:
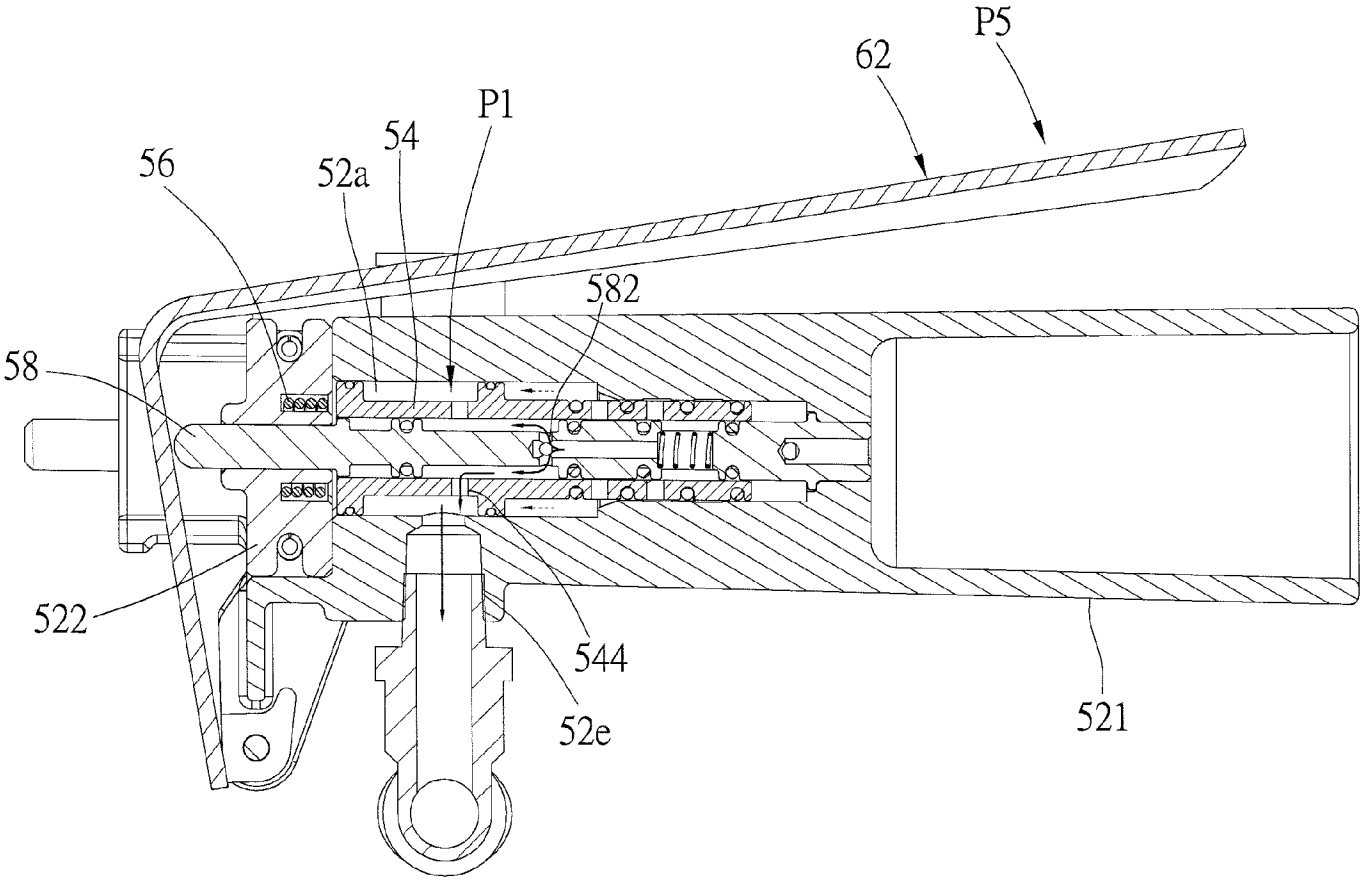
FIG. 7 follows FIG. 5, showing the relations between the components of the auxiliary handle while the auxiliary handle is just connected to the compressed gas supply.
Figure 8:
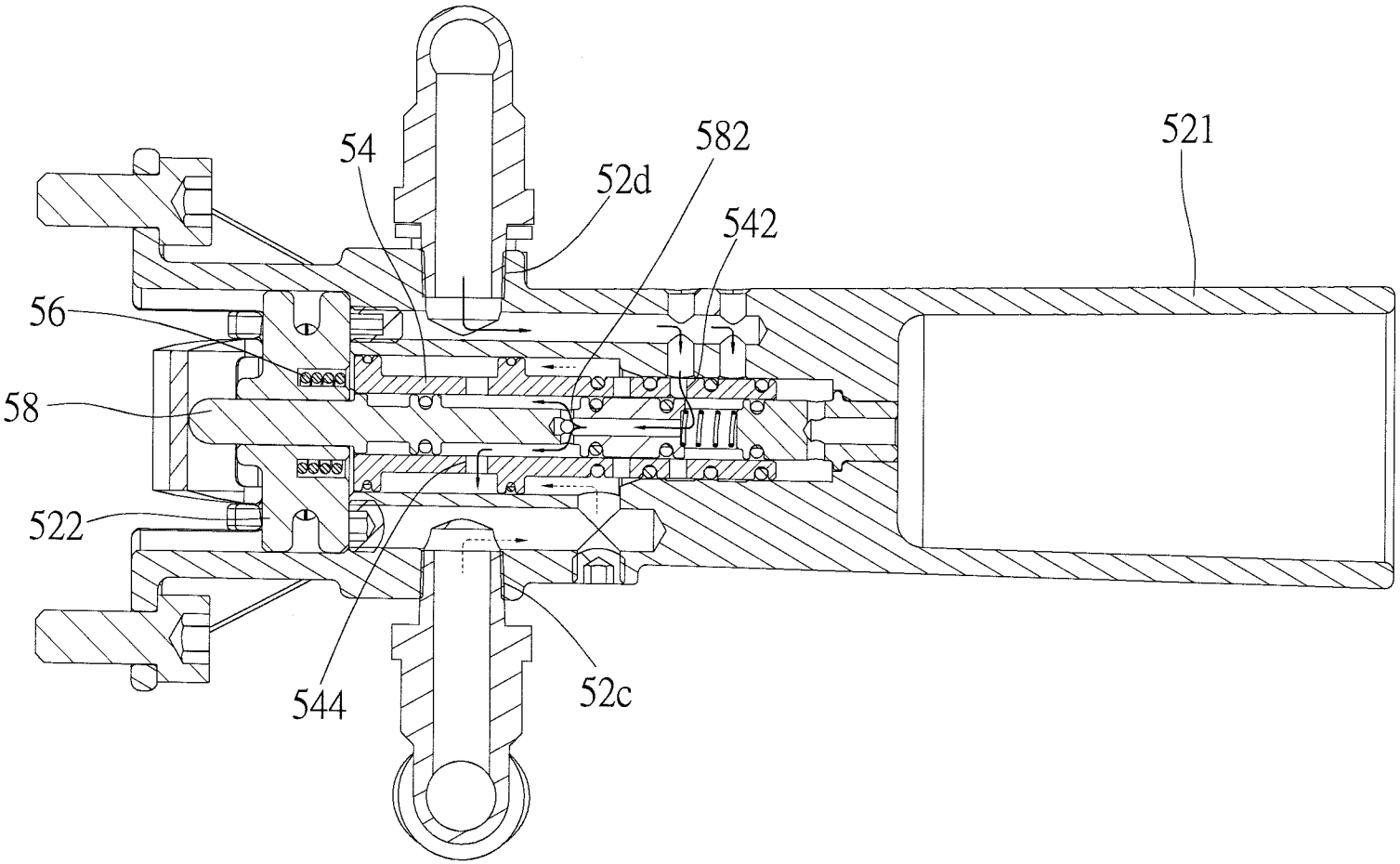
FIG. 8 follows FIG. 6, showing the relations between the components of the auxiliary handle while the auxiliary handle is just connected to the compressed gas supply.

The tube 54 is a round tube having an annular protrusion 541 on an outer surface. The tube 54 is provided with a plurality of first apertures 542, a plurality of second apertures 543, and a plurality of third apertures 544, wherein the first apertures 542 and the second apertures 543 are on a side of the protrusion 541 and the third apertures 544 are on the other side of the protrusion 541, and the second apertures 543 are closer to the protrusion 541 than the first apertures 542. The tube 54 is received in the room 52*a* of the gripping member 52 for reciprocation in the room 52*a*. As shown in FIG. 5 and FIG. 6, if the nail gun 100 is not connected to a compressed gas supply, the tube 54 is moved by the first urging member 56 to a second position P2; and while the nail gun 100 is connected to the compressed gas supply, a part of the compressed gas enters the room 52*a* via the first bore 52*c*, which is illustrated in FIG. 7 and FIG. 8. The pressure of the air in the room 52*a* will act on the protrusion 541 of the tube 54 to move the tube 54 along an opposite direction to a first position P1. The tube 54 will compress the first urging member 56 while the tube 54 is moved to the first position P1. The first urging member 56 is a spring, but not limited. A plurality of rings 55 are fitted to the tube 54 to divide the room 52*a* into two isolated chambers that may retain the compressed gas inside the inner chamber.

Figure 9:
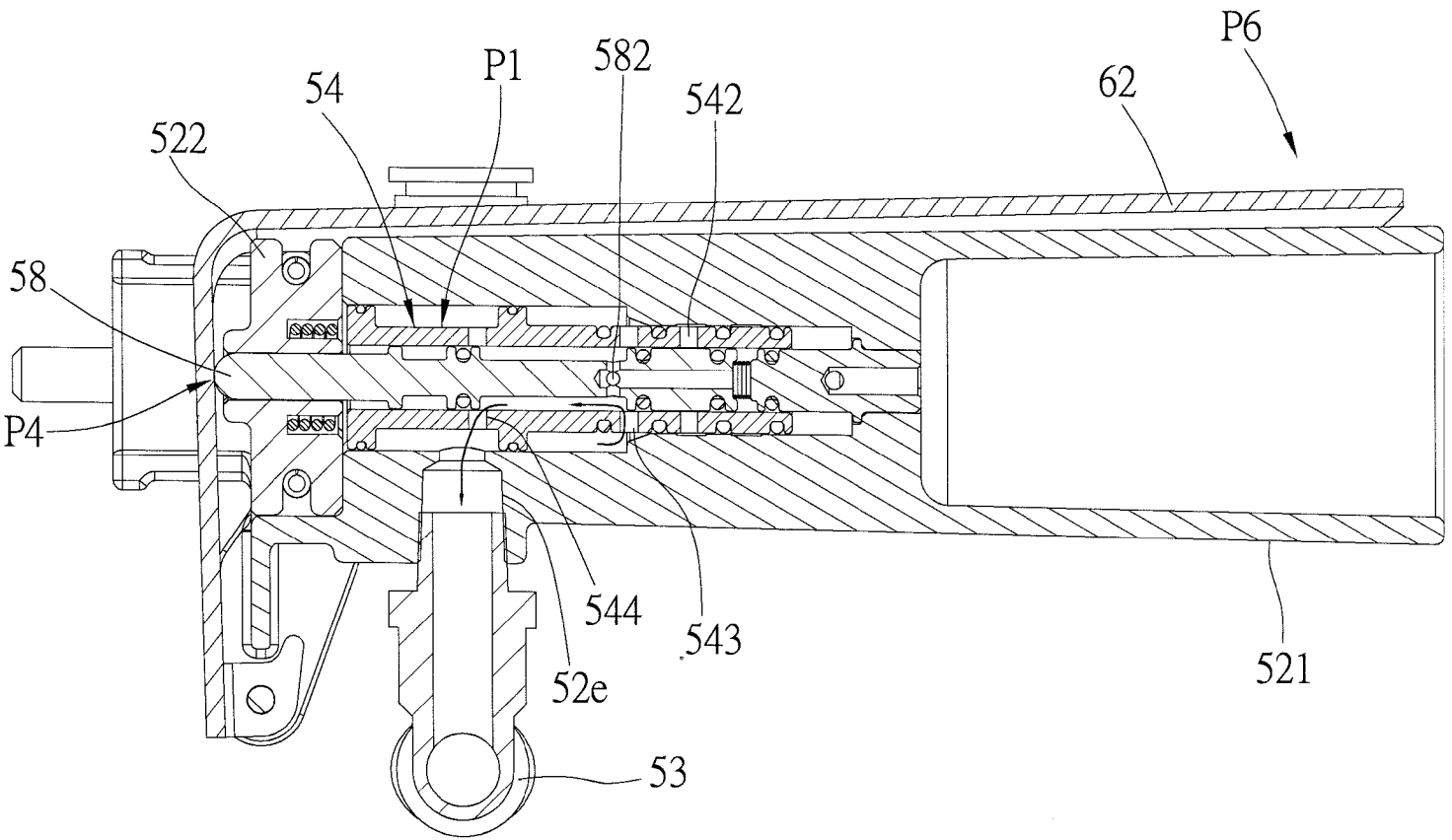
FIG. 9 follows FIG. 7, showing the relations between the components of the auxiliary handle while the trigger is pulled.

The pole 58 is received in the tube 54 for reciprocation. A plurality of rings 59 are fitted to the pole 58 for the same purpose as the rings 55. The pole 58 is moved by the second urging member 60 to a third position P3 when the nail gun 100 is not connected to a compressed gas supply as shown in FIG. 5 and FIG. 6. As the pole 58 is at the third position P3, a front end 581 of the pole 58 is extended out of the gripping member 52 via the opening 52*b* of the lid 522. On the contrary, when the pole 58 is pushed by the lever 62, it is moved to a fourth position P4, as shown in FIG. 9. The pole 58 has a channel 582 on an inner end. The second urging member 60 is a spring, but not limited.

The lever 62 is an L-shaped plate with an end pivoted on the front end of the shaft 521. The lever 62 is able to be pressed to a pressed position P6 (FIG. 9) from a normal position P5 (FIG. 7). The lever 62 has a pressing portion 621 and a gripping portion 622. The pressing portion 621 is in touch with the front end 581 of the pole 58, and the user may hold the gripping portion 622 to press the lever 62.

If the nail gun 100 is not connected to the compressed gas supply, as shown in FIG. 5 and FIG. 6, the pole 58 is moved by the second urging member 60 to the third position P3 to move the lever 62 to the normal position P5, and, at the same time, the tube 54 is moved by the first urging member 56 to the second position P2.

While the nail gun 100 is connected to the compressed gas supply, as shown in FIG. 7 and FIG. 8, the compressed gas enters the cylinder 10*a*, and some of the compressed gas enters the inner chamber of the room 52*a* via the hose 50*a* and the second bore 52*d*, and via the hose 50*c* and the first bore 52*c* respectively. The compressed gas via the first bore 52*c* (referring to in the arrows of dot lines in the FIG. 7 and FIG. 8) moves the tube 54 to the first position P1, and, at the same time, the compressed gas via the second bore 52*d* (referring to in the arrows of solid lines in the FIG. 7 and FIG. 8) flows through the first apertures 542, the channel 582, and the third apertures 544 in sequence, and then enters the hose 50*b* to the lid bore 10*c* to drive the nails.

Figure 10:
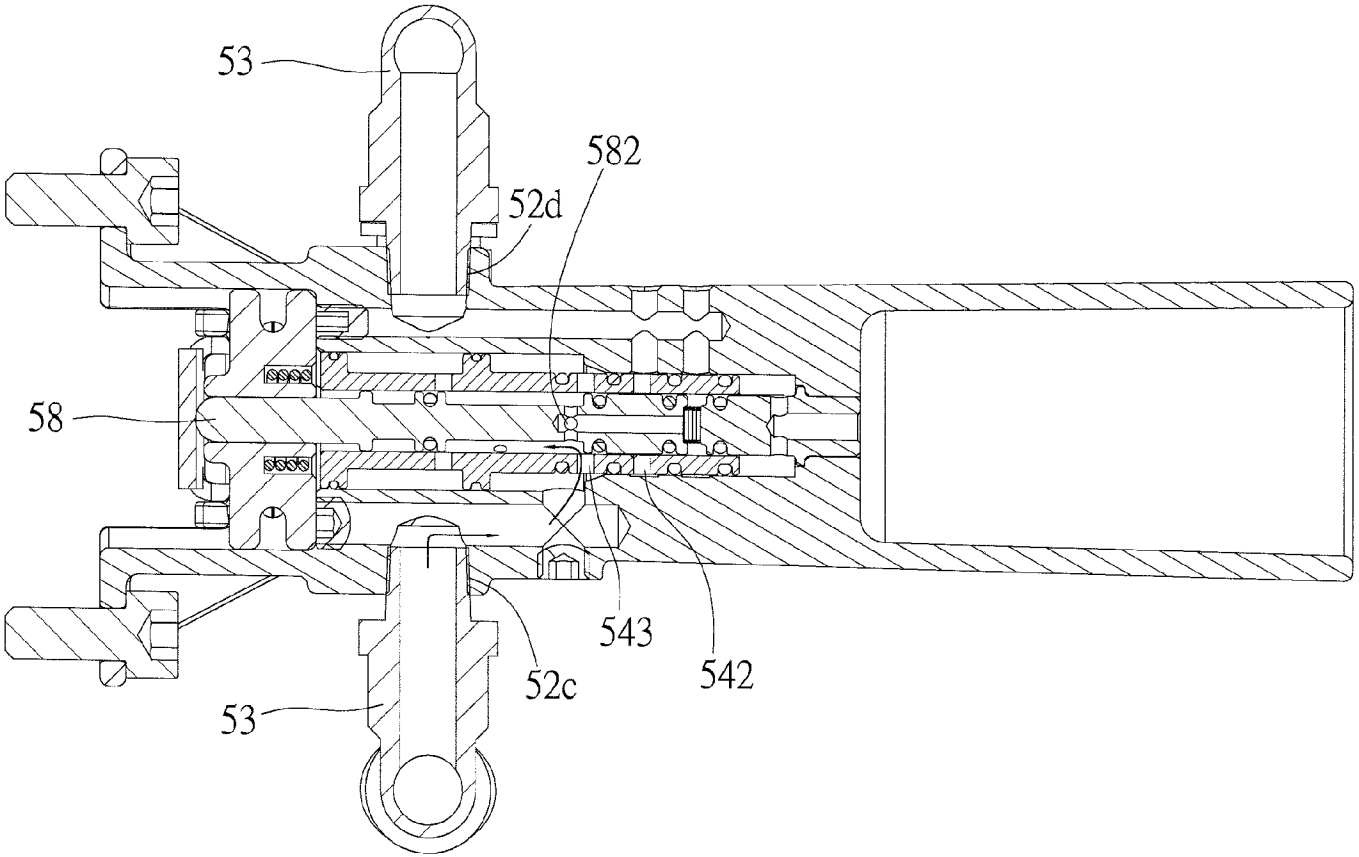
FIG. 10 follows FIG. 8, showing the relations between the components of the auxiliary handle while the trigger is pulled.

As shown in FIG. 9 and FIG. 10, when a user presses the lever 62 to the pressed position P6, the pressing portion 621 moves the pole 58 inwards to the fourth position P4. At this time, the pole 58 closes the first apertures 542 to cut off the passageway from the second bore 52*d* to the third bore 52*e*. However, the compressed gas flows from the first bore 52*c* to the third bore 52*e* through the second apertures 543 and the third apertures 544, and finally the compressed gas flows to the lid bore 10*c*.

When the user pulls the trigger 30, some of the compressed gas flows back to the room 52*a*, and escapes via the first bore 52*c* and the trigger 30. After a nail being shot, the first urging member 56 moves the tube 54 to the second position P2 because of the escape of the compressed gas. At this time, the first apertures 542 and the second apertures 543 of the tube 54 are communicated with the channel 582 of the pole 58 again, and the passageway between the second bore 52*d* and the third bore 52*e* is opened. The compressed gas in the cylinder 10*a* flows through the lid bore 10*c* again and waits for the next shooting.

With the action as described above, the tube 54 is moved to the first position P1 while the nail gun 100 connects to the compressed gas supply. If the user pulls the trigger 30 without pressing the lever 62, the compressed gas will be exhausted, and the tube 54 will be moved back to the second position P2, therefore the passageway between the second bore 53*d* and the third bore 52*e* will be opened. At this time, the nails in the nail gun 100 could not be shot even if the user presses the lever 62 again. In other words, the user has to press the lever 62 before pulling the trigger 30 to shoot nails. It is a safety shooting sequence for the nail gun 100.

It must be pointed out that the embodiments described above are only some preferred embodiments of the present invention. All equivalent structures which employ the concepts disclosed in this specification and the appended claims should fall within the scope of the present invention.

What is claimed is:

1. An auxiliary handle of a pneumatic tool, wherein the pneumatic tool has a trigger, the auxiliary handle comprising:

a gripping member, which is connected to the pneumatic tool, having a room therein and an opening communicated with the room; the gripping member further having a first bore, a second bore and a third bore, each of which is communicated with the room, wherein the first bore is closed or opened when the trigger is pulled;

a tube, which is received in the room of the gripping member to be moved between a first position and a second position, having a first aperture and a second aperture, wherein the tube is moved to the first position by compressed gas, which enters the room via the first bore;

a first urging member received in the room of the gripping member to keep moving the tube from the first position toward the second position;

a pole received in the tube to be moved between a third position and a fourth position, wherein the pole has a front end extending out of the gripping member through the opening;

a second urging member received in the room of the gripping member to keep moving the pole from the fourth position toward the third position; and a lever pivoted on the gripping member to be moved between a normal position and a pressed position, wherein the lever has a pressing portion in touch with the front end of the pole to move the pole to the fourth position when the lever is moved to the pressed position;

whereby the pole closes the first aperture of the tube, and the second aperture of the tube is communicated with the first bore and the third bore when the pole is moved to the fourth position, and a direction of a gas flow between the first bore and the third bore is changed by pulling the trigger.

2. The auxiliary handle of claim 1, wherein the gripping member has shaft, a lid and a plug; the first bore, the second bore, and the third bore are provided on the shaft, and the room is provided in the shaft; the lid is connected to an end of the shaft, and the opening is provided on the lid; the plug is received in the room to close an opposite end of the shaft.

3. The auxiliary handle of claim 1, wherein the pole is provided with a channel, and the tube further has a third aperture to be communicated with the channel.

* * * * *